US005553429A

United States Patent [19]

Schuster

[11] Patent Number: 5,553,429

[45] Date of Patent: Sep. 10, 1996

[54] BI-DIRECTIONAL BUILDING ARRANGEMENT

[76] Inventor: Jerry W. Schuster, 902 Queensbury Cir., Durham, N.C. 27713

[21] Appl. No.: 288,922

[22] Filed: Aug. 10, 1994

[51] Int. Cl.[6] ..... E04H 1/04

[52] U.S. Cl. ..... 52/234; 52/169.2

[58] Field of Search ..... 52/169.1, 169.2, 52/234

[56] References Cited

U.S. PATENT DOCUMENTS

| | | | |
|---|---|---|---|
| 1,464,189 | 8/1923 | Simonson . | |
| 3,479,781 | 11/1969 | Johnson | 52/169 |
| 3,732,649 | 5/1973 | Mehran | 52/169 |
| 3,874,137 | 4/1975 | Gentry | 52/169 |
| 4,232,490 | 11/1980 | Doane | 52/167 |
| 4,596,097 | 6/1986 | Stewart et al. | 52/185 |
| 4,718,205 | 1/1988 | Taylor | 52/234 X |
| 4,736,556 | 4/1988 | Scizak | 52/169.2 |
| 4,745,719 | 5/1988 | Blankstein | 52/234 |

FOREIGN PATENT DOCUMENTS

| | | | |
|---|---|---|---|
| 209564 | 8/1990 | Japan | 52/234 |
| 405156824 | 6/1993 | Japan | 52/234 |

OTHER PUBLICATIONS

Chicago–Area Townhomes Offer Single–Family Detached Feel Professional Builder And Remodeler, Dec. 1, 1991 p. 71.

Two In One Builder Magazine, Jan., 1991 p. 164.

*Primary Examiner*—Carl D. Friedman
*Assistant Examiner*—Yvonne Horton-Richardson

[57] ABSTRACT

A building arrangement wherein two separate units are incorporated into a single structure. A main access for each unit is provided on opposite sides of the structure creating a discreet relationship between the units. A common wall assembly between the two units is segmented in shape making the presence of the common wall less noticeable.

16 Claims, 6 Drawing Sheets

BI-DIRECTIONAL BUILDING ARRANGEMENT

BACKGROUND-FIELD OF INVENTION

This invention relates to building arrangements, specifically to two unit structures which are accessible from opposite directions.

BACKGROUND-DESCRIPTION OF PRIOR ART

Although people have been living and working in structures for centuries, our current population has some properties unique in all of history. The baby boomer generation is now middle aged. They are more affluent, better educated, and with greater life expectancy than any generation that precedes them. They arrive at this point in life with older children or, increasingly, with no children. These people are involved with careers and active at play and don't necessarily need the burden of a single family home.

In addition, younger couples are often waiting many years before having children, or making the decision not to have them at all.

These folks, you might think, would be excellent candidates for condominium or townhouse living. Busy with careers, sports, and hobbies, they would benefit from a low maintenance, easy care situation that affords them access to their desired lifestyle.

The reality, however, is that a large number of these people buy single family homes in neighborhoods that, in the past, were almost the sole bastion of families. Why is this?

The answer is that these people have worked hard to achieve a certain station in life and have certain expectations of what being successful is all about. Part of that expectation is owning a single family home in a desirable neighborhood. Their actual needs may not be best served by a large, single family home, but that's not necessarily the real issue. Their desires and preconceptions, however, are a real issue. They view attached living, such as a townhouse or duplex, as a comedown from their life long hopes and dreams; kind of like being relegated to apartment living. What they want is a nice house that says, "Hey, I've made it." And, they want that even if it doesn't address some of the needs of their lifestyles.

Therefore, there exists in the present housing market, a significant niche that is not being served due to a lack of acceptable alternatives.

Many designers and architects have worked at creating products to fill this niche and some have been successful, to a degree, with new and unique housing arrangements. For example, Stewart—U.S. Pat. No. 4,596,097 (1986), provides for two units which are accessed from opposite sides of the building whereby the living quarters are in a stacked relationship. These are townhouse units, however, and suffer from the same defects as all such units. They have a smallish appearance and are clearly attached units.

A somewhat more suitable design is that of Mehran—U.S. Pat. No. 3,732,649 (1973), which is essentially a duplex with the overall structure having the appearance of a single family home. However, this unit displays three problems not acceptable to discerning people. 1 The entrance doors to these structures are in an unusual location. One is on the front, but the other is in an unnatural position on the side. 2 The common wall between the units is straight and anyone living in the units will be conscious of the common wall. In fact, this is one of the most obvious issues in all multi-family housing; the awareness of the common wall. 3 Since both units are accessed from the same street, it is certain that the units will be recognized to be what they are—duplexes.

In addition to the above, a large variety of designs, including cluster homes, duplexes, and fourplexes have proliferated in recent years. All of these have shortcomings which do not address the needs of a significant proportion of the previously mentioned market niche. Either they look small or are obviously attached housing, or frequently, both. None of these building arrangements disclose or contemplate the specific features of the present invention.

OBJECTS AND ADVANTAGES

The present invention offers a dwelling that appears to be constructed as a single family house, but which is in fact is a carefully concealed two-family structure. Because the resulting house is larger than what could be built as an individual unit, the appearance will be that of a significantly more expensive home than could have otherwise been afforded. In addition, the home will be less expensive to furnish, provide utilities for, and maintain than a larger, single-family house.

This is accomplished by creating a bi-directional structure which has following characteristics:

(a) Each unit is approached and entered from the opposite direction, probably an entirely different street. This means that each unit, in fact, has no back to it. The back side is actually the front side of the other unit. Since the land that would normally be used by two single family homes is combined, the house is set further back from the street for a more "regal" appearance. Or, the land area can be reduced increasing the density of houses per acre. Each side looks like a home which is much more expensive due to the increased width, mass, and interest of the structure. This is accomplished without the resultant large amount of square footage in a larger home which may not be used and adds to the upkeep.

(b) The common wall between the units is segmented and irregularly shaped ("Z" shaped as shown in the drawings). Most multi-family homes have a straight common wall which divides the structure in two. The result leaves people with a definite sense of being an attached property (claustrophobic). By putting visible space to both the right and left side of the entry, and positioning the main entry near the center of the front of the structure (this position would be located as if the structure is actually a single family home) a feeling of expansiveness can be created. In addition, by making the common wall segmented and irregular in shape so that it changes directions throughout the join between the units, the sensation of the common wall is either virtually eliminated or greatly reduced.

Further objects and advantages of my invention will become apparent from a consideration of the drawings and ensuing description.

DRAWING FIGURES

Figure 1A:
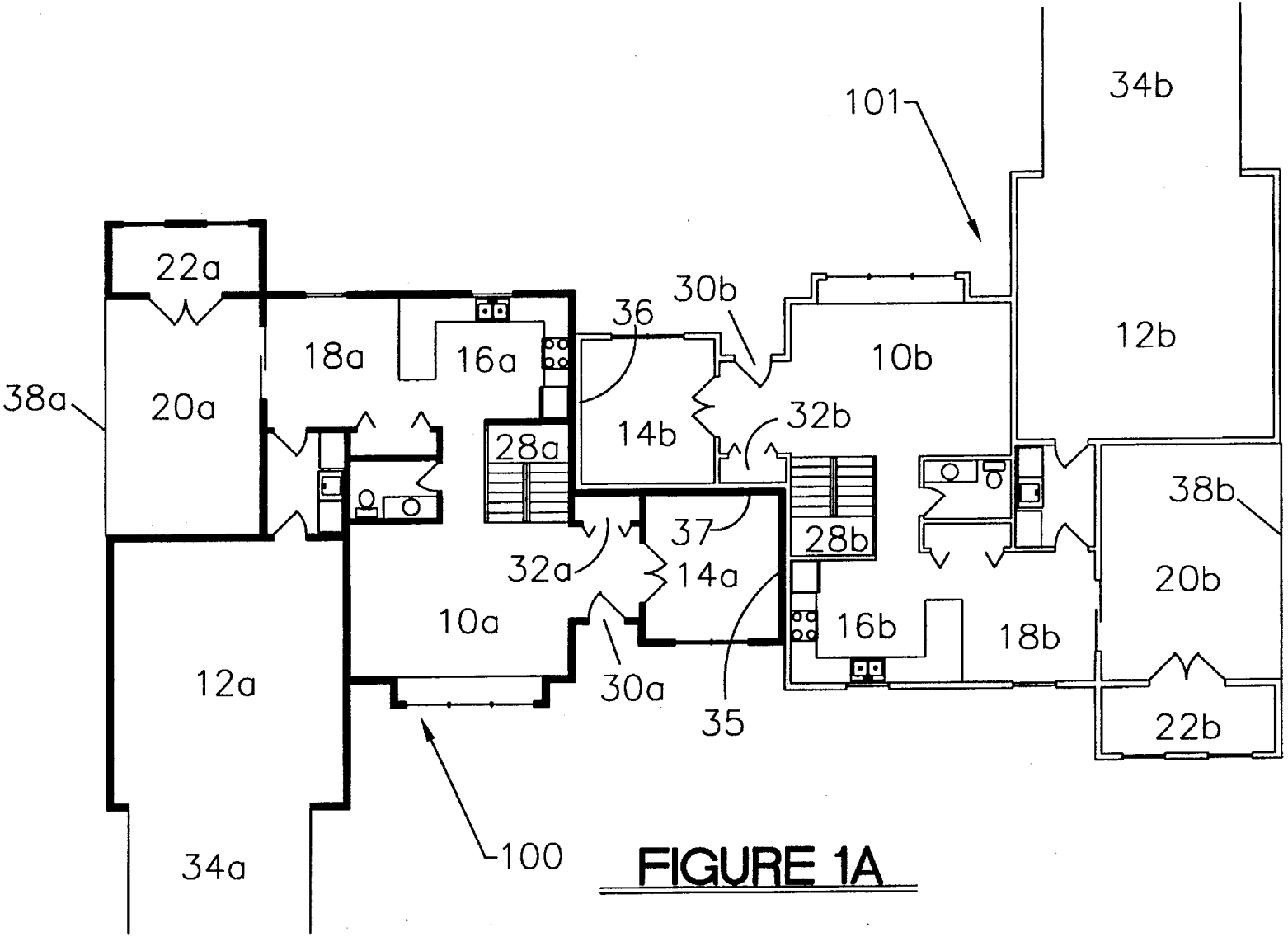
FIG. 1A is the plan view of the main floor layout of the structure.
Figure 1B:
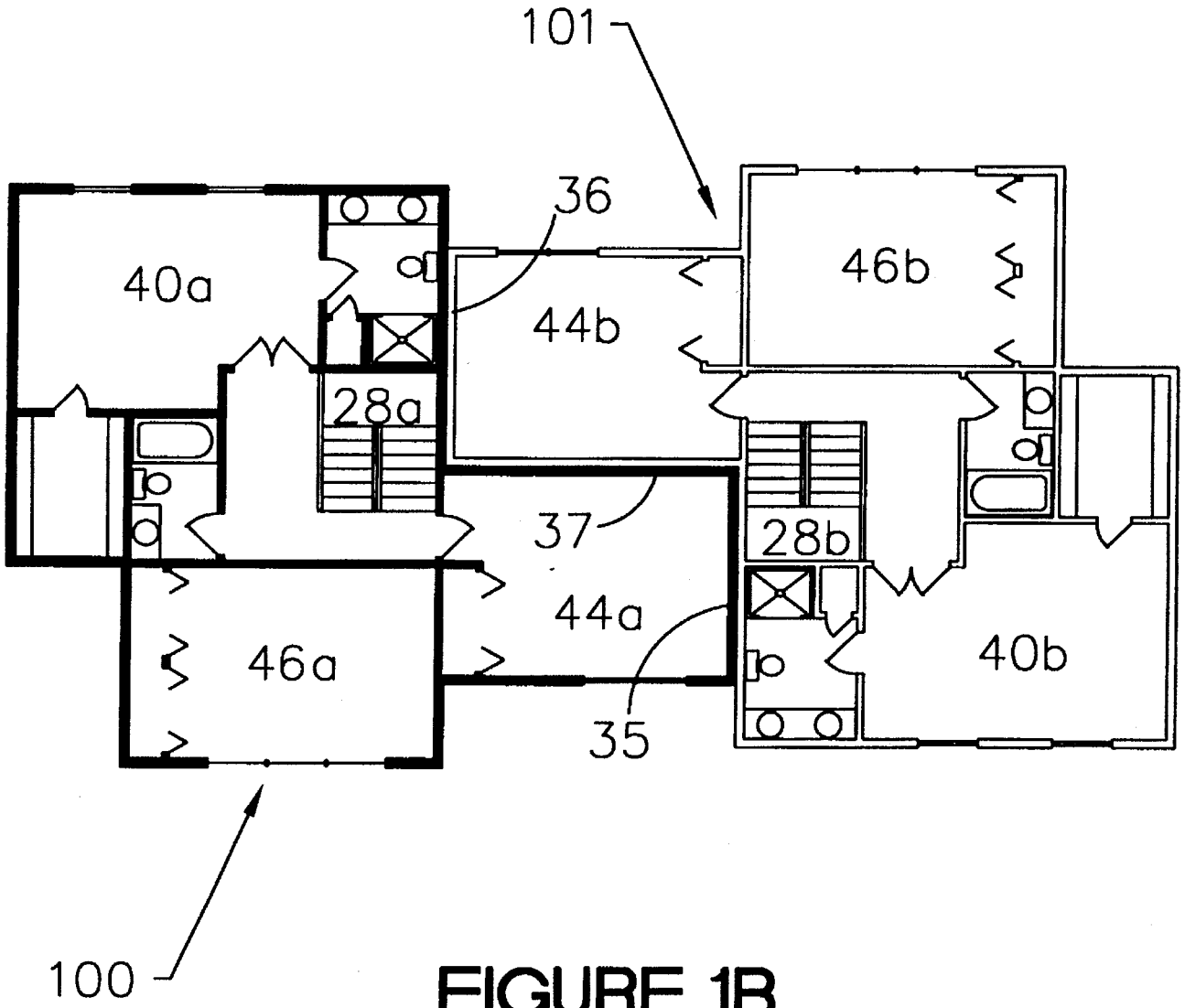
FIG. 1B is the plan view for the second floor plan view for both units of the bi-directional structure.

A segmented common wall assembly 35,36,37, which is "Z" shaped in FIGS. 1A and 1B can be constructed by any of several known means for retarding the transference of acoustical energy providing for privacy and quiet living conditions. The exact method used is not of importance to the invention.

Front door 30*a* to left dwelling unit 100 and front door 30*b* to right dwelling unit 101 are located on opposite sides of the building further enhancing the separate nature of the units. A prime factor of the invention is that entrances 30*a* and 30*b* may be positioned in such a manner that they appear as if they are a part of a larger, single family structure.

Reference Numerals in Drawings

Figure 4:
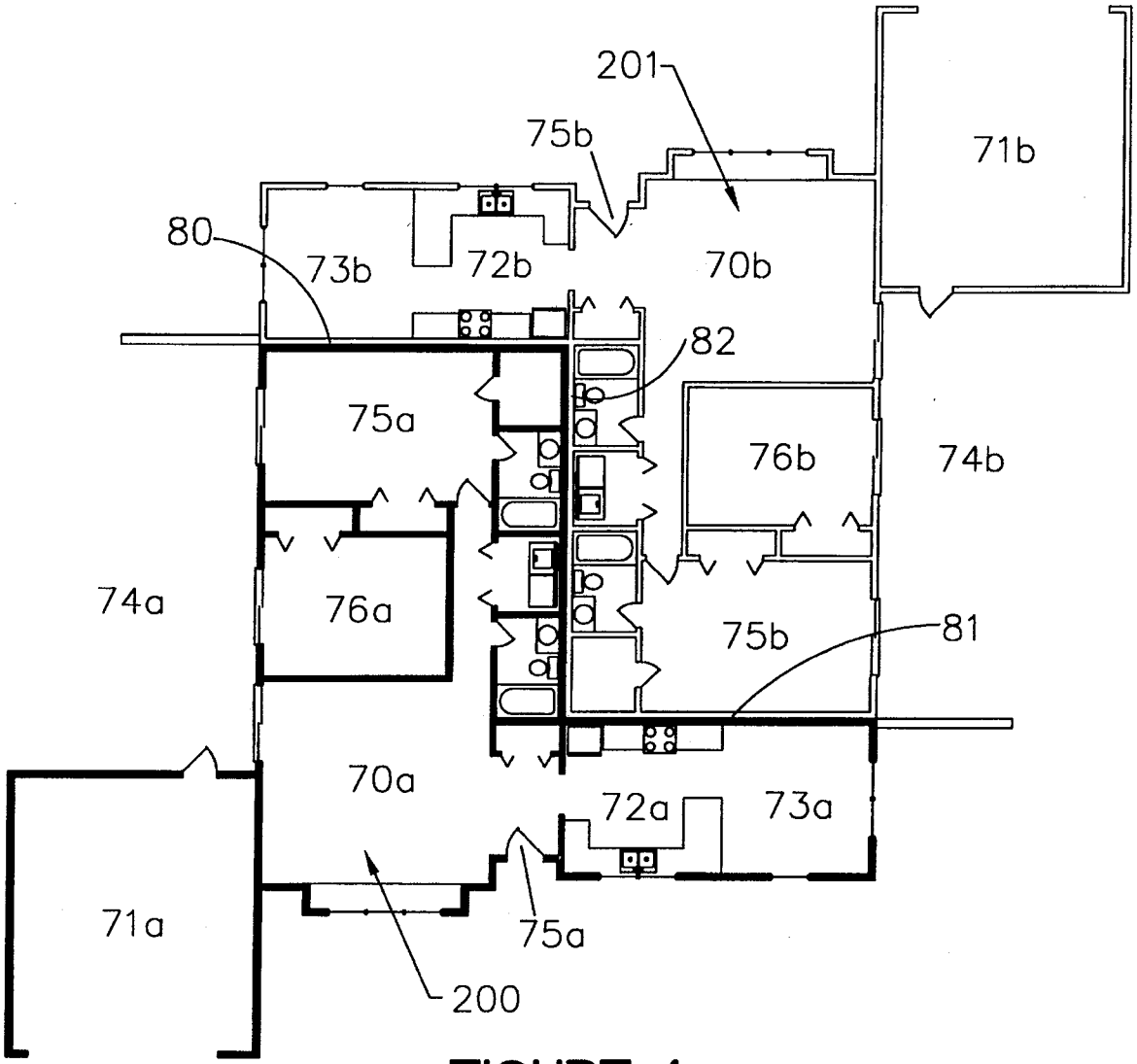
FIG. 4 is an alternative floor plan showing the common wall assembly located in a side to side relationship with the structure.
Figure 5:
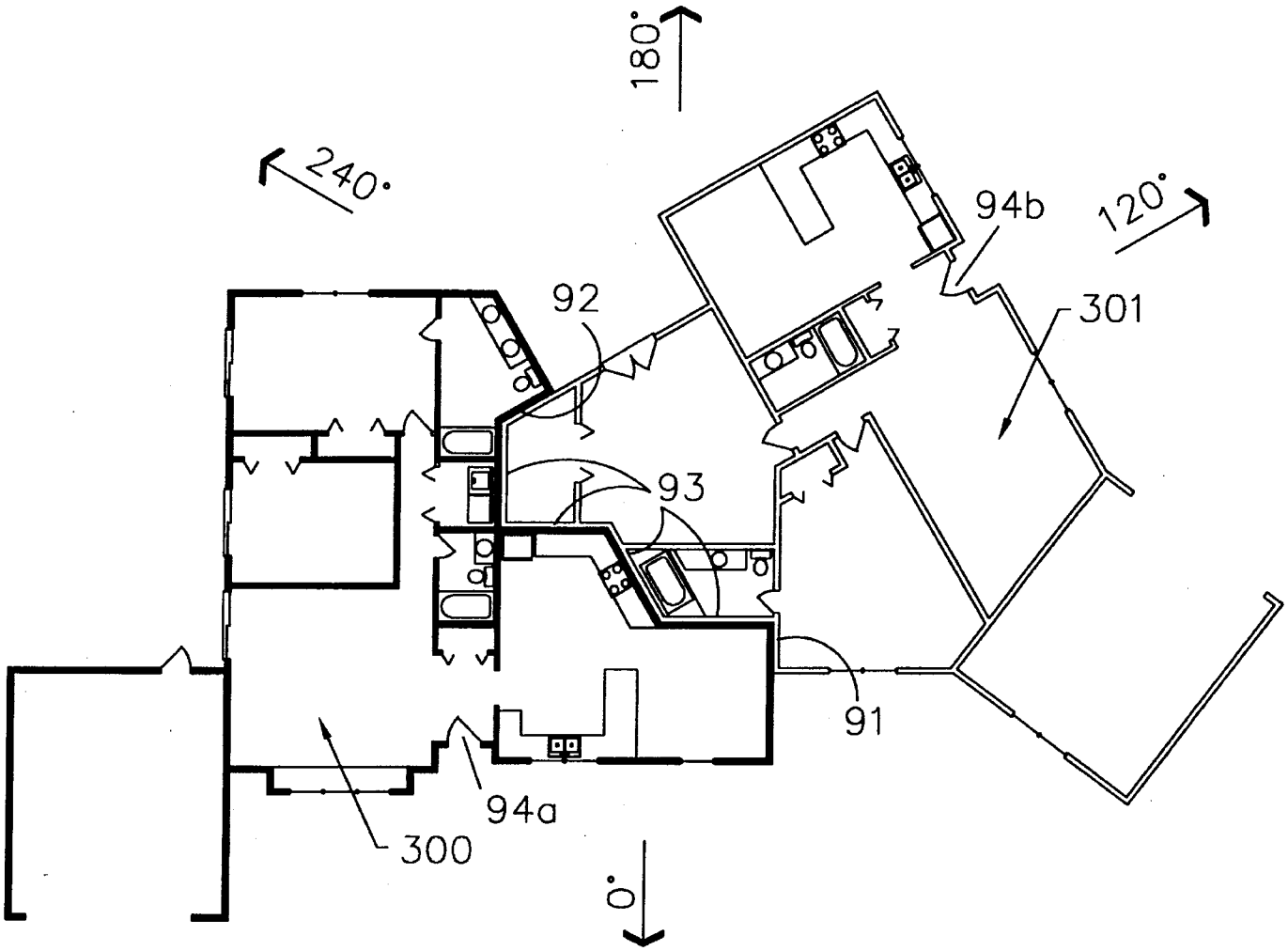
FIG. 5 is a second alternative floor plan showing some important ramifications and variations on bi-directional structures.

| | | | |
|---|---|---|---|
| 100 | Left dwelling unit (FIGS. 1A & 1B) | 12b | Garage in unit 101 |
| 101 | Right dwelling unit (FIGS. 1A & 1B) | 14a | Den in unit 100 |
| 10a | Living room in unit 100 | 14b | Den in unit 101 |
| 10b | Living room in unit 101 | 16a | Kitchen in unit 100 |
| 12a | Garage in unit 100 | 16b | Kitchen in unit 101 |
| 18a | Breakfast area in unit 100 | 200 | Front dwelling unit-FIG. 5 |
| 18b | Breakfast area in unit 101 | 201 | Rear dwelling unit-FIG. 5 |
| 20a | Courtyard in unit 100 | 70a | Living room in unit 200 |
| 20b | Courtyard in unit 101 | 70b | Living room in unit 201 |
| 22a | Storage shed in unit 100 | 71a | Garage in unit 200 |
| 22b | Storage shed in unit 101 | 71b | Garage in unit 201 |
| 28a | Stairs in unit 100 | 72a | Kitchen in unit 200 |
| 28b | Stairs in unit 101 | 72b | Kitchen in unit 201 |
| 30a | Front door in unit 100 | 73a | Breakfast area in unit 200 |
| 30b | Front door in unit 101 | 73b | Breakfast area in unit 201 |
| 32a | Coat closet in unit 100 | 74a | Courtyard in unit 200 |
| 32b | Coat closet in unit 101 | 74b | Courtyard in unit 201 |
| 34a | Driveway in unit 100 | 75a | Front door in unit 200 |
| 34b | Driveway in unit 101 | 75b | Front door in unit 201 |
| 35 | First common wall member (FIGS. 1A & 1B | 80 | Left common wall member (FIG. 4) |
| 36 | Second common wall member (FIGS. 1A & 1B) | 81 | Right common wall member (FIG. 4) |
| 37 | Connecting common wall member (FIGS. 1A & 1B) | 82 | Connecting common wall member (FIG. 5) |
| 38a | Courtyard fence in unit 100 | 74a | Courtyard fence in unit 200 |
| 38b | Courtyard fence in unit 101 | 74b | Courtyard fence in unit 201 |
| 40a | Master bedroom in unit 100 | 75a | Master bedroom in unit 200 |
| 40b | Master bedroom in unit 101 | 75b | Master bedroom in unit 201 |
| 44a | Bedroom #2 in unit 100 | 76a | Bedroom #2 in unit 200 |
| 44b | Bedroom #2 in unit 101 | 76b | Bedroom #2 in unit 201 |
| 46a | Bedroom #3 in unit 100 | 300 | Front dwelling unit (FIG. 5) |
| 46a | Bedroom #3 in unit 101 | 301 | Rear dwelling unit (FIG. 5) |
| 54 | Dividing point | 91 | Common wall member #1 (FIG. 5) |
| 56 | Roof | 92 | Common wall member #2 (FIG. 5) |
| 60 | Interior streets | 93 | Connecting common wall member (FIG. 5) |
| 62 | Exterior streets | 94a | Front door in unit 300 |
| | | 94b | Front door in unit 301 |

DESCRIPTION-FIGS. 1 TO 5

A typical embodiment of the design of the present invention is illustrated in FIG. 1A (Plan View—Main Floor) and FIG. 1B (Plan View—Second Floor). This is a two family bi-directional structure with two stories in each unit. A left dwelling unit 100 is identical to a right dwelling unit 101 except that they are oriented 180 degrees from each other.

The units are joined together by using a common wall assembly comprised of three segments. A first common wall member 35 intersects the face of the left dwelling unit 100 to form the first segment, a second common wall member 36 intersects the face of the right dwelling unit 101 to form the second segment. Each of these common wall members 35 and 36 is offset from the other. The third segment of the common wall assembly is a connecting common wall member 37 which joins the first common wall member 35 and second common wall member 36 together thereby providing a continuous common wall to separate the left dwelling unit 100 from the right dwelling unit 101.

Driveways 34*a* and 34*b* leading to garages 12*a* and 12*b* of each unit are approached from opposite directions to make discreet the fact that this is a two family structure.

The main floor plan of each unit as shown in FIG. 1A contains a living room 10*a* and 10*b*, den 14*a* and 14*b*, kitchen 16*a* and 16*b*, breakfast area 18*a* and 18*b*. In addition, the units have a courtyard 20*a* and 20*b* with outside storage areas 22*a* and 22*b*. Each courtyard 20*a* and 20*b* is enclosed with a fence 38*a* and 38*b*.

The second floor plan of each unit as shown in FIG. 1B contains a master bedroom 40*a* and 40*b* and secondary bedrooms 44*a*, 44*b*, 46*a* and 46*b*. Closets, baths, and other areas normally associated with a residential structure are shown but not noted here as they are not material to describing the invention.

A prominent feature of the invention is that upon entering the front door 30*a*, as depicted in FIG. 1A—the left dwelling unit 100, the den 14*a* is to the right and the living room 10*a* is to the left. This configuration is completely normal and expected in a single family home, but not normally found in multi-family housing. This is accomplished by employing the segmented shape of the common wall assembly 35, 36, 37. The right unit 101 has the same rooms in the same configuration except for their orientation from 180 degrees in the opposite direction.

An additional benefit of a segmented shaped common wall assembly 35, 36, 37 is that a closet 32*a* and stairs 28*a* are placed against the common wall assembly 35, 36, 37 further increasing the acoustical separation of each unit. The placement of these elements at the corners of the common wall assembly 35, 36, 37 increases the concealment of the fact that the structure is a two-family unit.

With this arrangement, there is no back yard, however private outdoor space is provided with the side courtyards 20*a* and 20*b*.

Figure 2:
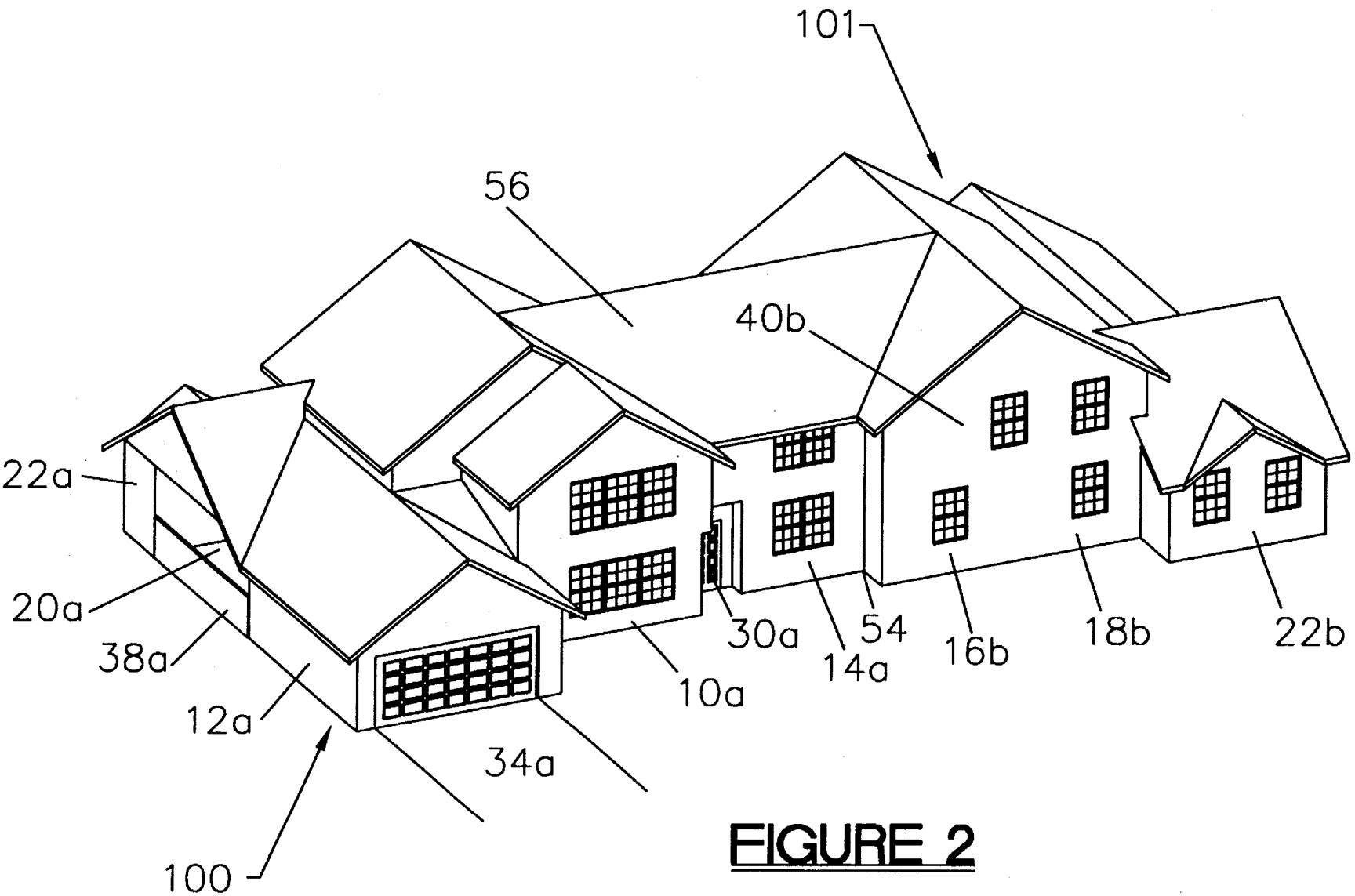
FIG. 2 is an isometric view of one of the front sides of the structure illustrating the true resemblance to a single family structure. The view of the other side of the structure would appear exactly as shown here.

FIG. 2 (Isometric View) is an isometric view of one side of the structure. Since each side of the structure is identical, either side would appear the same. This looks like a large, single family house, however the dividing point 54 is the location where the common wall occurs. Living space to the left of the dividing point 54 belongs to the left unit 100 and living space to the right of the dividing point 54 belongs to the right unit 101.

A roof 56 can be more complex and interesting on this bi-directional structure than can be obtained if these were two separate units constructed as single family homes. An approach to the home from the street or driveway 34*a* and the position of an entry door 30*a* give few clues to the fact that this is a two-family home.

In this view, the rooms facing the approach to the house are a living room 10*a*, a den 14*a* from the left unit 100 and a kitchen 16*b*, a breakfast area 18*b*, and a storage room 22*b* from the right unit 101.

Figure 3:
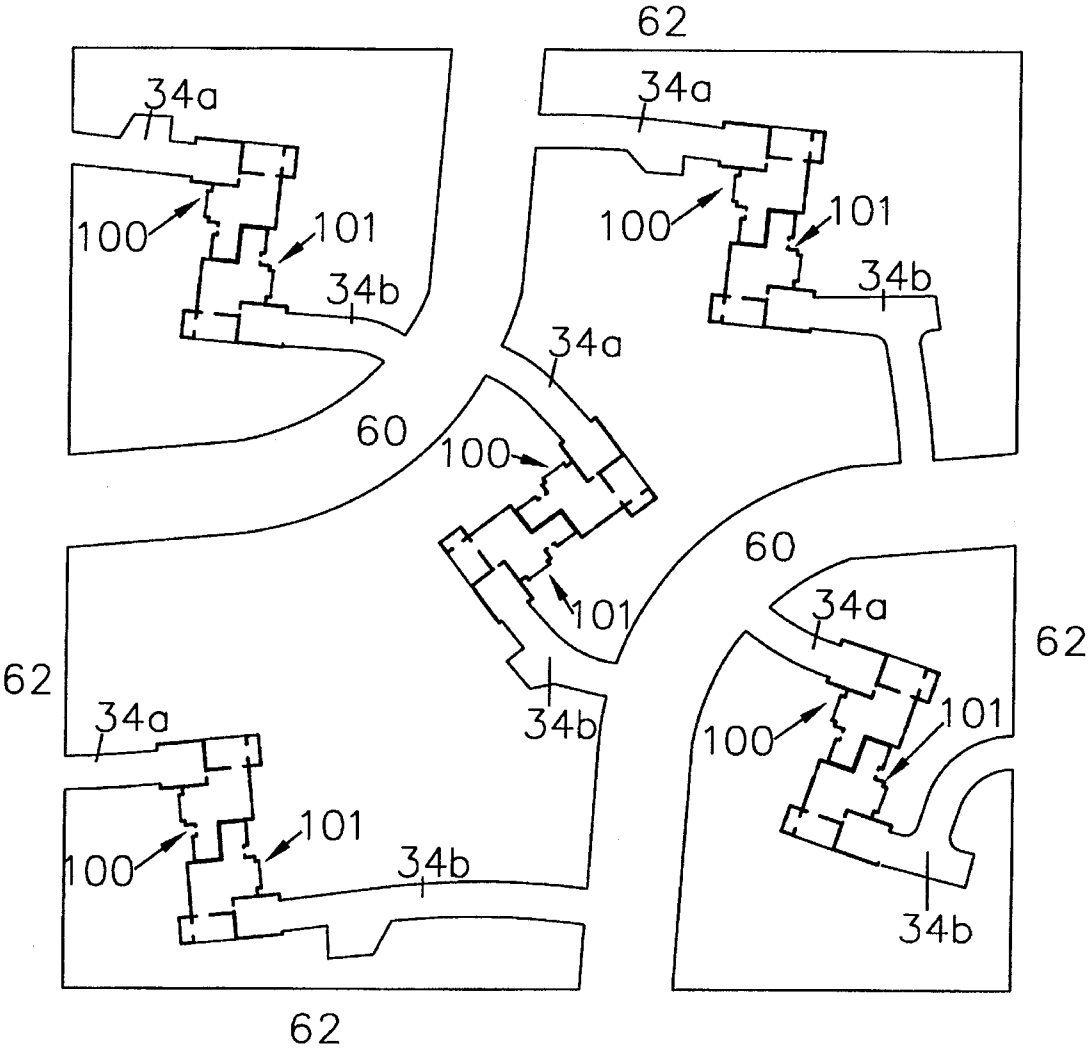
FIG. 3 is a small subdivision plan demonstrating the relationship of the structures and how they are entered from opposite directions.

FIG. 3 (Subdivision Plan) is a suggested layout of 5 bi-directional houses—a total of 10 living units placed in a subdivision. Interior streets 60 could be used for access to the units as could exterior, throughway streets 62. Driveways 34*a* and 34*b* approach their respective units 100 and 101 in a variety of styles, but always from an opposite direction. There are various possibilities for orientation of units and placement of driveways as long as the premise of the invention is adhered to.

In FIG. 4 (Alternative Floor Plan), depicts a one story home comprised of a front dwelling unit 200 and a rear dwelling unit 201. Like the floor plan in FIGS. 1A and 1 B, there is a common wall assembly separating the two units from each other. However, the common wall assembly is oriented to the structure in a side to side relationship rather than a front to back relationship. A left common wall member 80 intersects the left side of the structure to form the first segment, and a right common wall member 81 intersects the right side of the structure to form the second segment. These segments are offset from each other and joined together by a connecting common wall member 82 to complete the common wall assembly.

Front door 75*a* to front dwelling unit 200 and front door 75*b* to rear dwelling 201 are located on opposite sides of the structure and, as in the previous description, are positioned to appear as if they are part of a single family structure. Each unit has a kitchen 72*a* and 72*b* and a breakfast area 73*a* and 73*b* to the right when entering through the front doors 75*a* and 75*b*. A living room 70*a* and 70*b* is to the left in each instance.

Garages 71*a* and 71*b* of each unit are approached from opposite directions to conceal the two-family nature of the structure. A courtyard 74*a*, master bedroom 75*a*, and bedroom #2 76*a* complete front dwelling 200. A courtyard 74*b*, master bedroom 75*b*, and bedroom #2 76*b* complete rear dwelling 201. Once again, closets, baths, and other areas normally associated with a residential structure are shown but not noted.

FIG. 5 (Second Alternative Floor Plan) shows several important ramifications to the preferred embodiment. To avoid confusion, individual rooms are not marked or described as they are above. Only those elements necessary to discern the nature of these embodiments are described.

Most prominently, a rear unit 301 is oriented at an angle of 120 degrees in relation to a front unit 300. This is in contrast to the previous layouts where the units were oriented at 180 degrees with respect to each other. Any angle of orientation which falls between 120 degrees and 240 degrees will meet the criteria of the invention. Or, to phrase it differently, a variation of 60 degrees to either side of a 180 degree orientation between each unit is acceptable.

A front door 94*a* to front dwelling unit 300 defines the front face of that unit. A front door 94*b* defines the front face of the rear dwelling unit 301. Direction arrows display the 120 degree, 180 degree, and 240 degree rotation from the front dwelling unit 300 which is oriented in the direction of 0 degrees.

Another important ramification shows the connecting common wall member 93 as segmented itself and at differing angles, where in the previous descriptions it was always straight. Any method of joining together a common wall member #1 91 and common wall member #2 92 will provide a continuous common wall assembly.

An additional important ramification shown in FIG. 5 is that the front dwelling unit 300 and rear dwelling unit 301 are of different floor plans. In the previous descriptions they are identical except for being oriented 180 degrees with respect to each other. Dwelling units do not need to be identical to serve the purpose of this invention.

SUMMARY, RAMIFICATIONS AND SCOPE

Accordingly, the reader will appreciate that by accessing a two family structure from opposite sides, in combination with a segmented common wall assembly, a structure can be designed and/or built which looks and feels like a single family home. Most of the objections that are faced with standard, duplexes are eliminated or greatly reduced.

By carefully concealing the fact that this is a two-family structure, many people who would normally find attached housing unacceptable, will now find that they can purchase a home which appears much larger and more impressive than they could otherwise afford. In addition, the home would be less expensive to furnish and maintain than a larger, single-family house. The arrangement of this structure, therefore, achieves all of the ends and objectives set forth in this document. Although the description above contains many specifics, these should not be construed as limiting the scope of the invention but as merely providing illustrations of some of the presently preferred embodiments of this invention.

The following examples explain variations to the preferred embodiment:

- While the description provides for both units to have the same floor plan, in reality the units could be entirely different. This could be done purposefully or to accommodate some other factor, such as a sloping lot, restricted space, model variety or many other factors.
- The segmented common wall assembly is shown in a "Z" shape, but could be in other shapes such as angled, zigzagged, freeform, curvilinear, etc.

In addition, while the preferred embodiment shows the two units oriented at 180 degrees with each other, a variation of as much as 60 degrees could still be possible so long as the front of each unit were not generally visible to each other.

The placement of the rooms in the structure can be varied to an almost endless degree. For instance, instead of the den being to the right of the entrance, it could be a kitchen, living room, sun room, etc.

While the structure shown places the units so that the main body of the living space is to the left of the entry. The structure could be reversed so that the main body of living space is to the right of the entry.

The overall style of the structure could conform to any known style including traditional, modern, transitional, etc. In addition the structure could be a single story, two story, multi-story, multi-level, etc. It could have a one car garage, multi-car garage, or no garage. In fact, the whole idea of the invention is to create a two family home which looks, and generally functions, like established styles of architecture for single family homes.

Garages could be entered from other direction besides straight in. For instance, on a corner lot or any other lot of appropriate size and shape, entry to the garage could be from the side. In addition, the garage could be set at an angle different from the face of the structure.

The description sets forth a residence for purpose of explanation. But the invention need not be limited to dwellings. Retail stores, offices, and other commercial structures could be produced to take advantage of the invention.

Thus the scope of the invention should be determined by the appended claims and their legal equivalents, rather than by the examples given.

I claim:

1. A bi-directional building arrangement comprising:

(a) a composite building structure including exactly two separate units having a common wall assembly therebetween, (b) said separate units being arranged wherein the main entry of the first unit is substantially on the opposite side of the building from the second unit, (c) said common wall assembly comprises a minimum of three individual wall segments all joined together to bisect the structure, thereby providing a continuous common wall between said separate units.

2. The bi-directional building arrangement of claim 1, wherein the composite building structure is a residential-type dwelling.

3. The bi-directional building arrangement of claim 1, wherein said separate units are of different size.

4. The bi-directional building arrangement of claim 1, wherein said separate are of a different shape.

5. The bi-directional building arrangement of claim 1, wherein the main entry of the first unit is oriented at an angle of at least 120 degrees and not more than 240 degrees with respect to the entry of the second unit.

6. The bi-directional building arrangement of claim 5, wherein the main entry of the first unit is oriented at 180 degrees with respect to the entry of the second unit.

7. The bi-directional building arrangement of claim 1, wherein any two individual wall segments of said common wall assembly are joined at a 90 degree angle with respect to each other.

8. The bi-directional building arrangement of claim 1, wherein individual wall segments of said common wall assembly are 8 feet or greater in length.

9. A bi-directional building arrangement comprising: p1

(a) a single structure for the purpose of providing habitation by humans which is divided into two distinct units with a common wall separating each unit from the other, (b) said distinct units to be located in such manner as to provide a frontal access to each distinct unit on substantially opposite sides of said single structure, (c) said distinct units joined together in an interlocking manner at said common wall, said common wall being divided into three or more individual segments.

10. The bi-directional building arrangement of claim 9, wherein said single structure is a residential-type dwelling.

11. The bi-directional building arrangement of claim 9, wherein one said distinct unit is larger than the other said distinct unit.

12. The bi-directional building arrangement of claim 9, wherein said distinct units have layouts which are not identical.

13. The bi-directional building arrangement of claim 9, wherein said frontal access to each distinct unit is aligned at an angle of 180 degrees with respect to each other and with an allowed variation of said angle of plus or minus 60 degrees.

14. The bi-directional building arrangement of claim 13, wherein said frontal access to each distinct unit is aligned at an angle of 180 degrees with respect to each other.

15. The bi-directional building arrangement of claim 9, wherein any one segment of said common wall, where attached to any other segment of said common wall, is joined in a 90 degree angle with respect to each other.

16. The bi-directional building arrangement of claim 9, wherein said individual segments of said common wall are not less than 8 feet in length.

* * * * *